US007367750B2

(12) United States Patent
Pollack et al.

(10) Patent No.: US 7,367,750 B2
(45) Date of Patent: May 6, 2008

(54) RISER INSTALLATION VESSEL AND METHOD OF USING THE SAME

(75) Inventors: Jack Pollack, Houston, TX (US); Leendert Poldervaart, Monte-Carlo (MC)

(73) Assignee: Single Buoy Moorings Inc., Marly (CH)

( * ) Notice: Subject to any disclaimer, the term of this patent is extended or adjusted under 35 U.S.C. 154(b) by 198 days.

(21) Appl. No.: 10/531,576

(22) PCT Filed: Oct. 15, 2003

(86) PCT No.: PCT/NL03/00695

§ 371 (c)(1),
(2), (4) Date: Nov. 22, 2005

(87) PCT Pub. No.: WO2004/035375

PCT Pub. Date: Apr. 29, 2004

(65) Prior Publication Data

US 2006/0140726 A1 Jun. 29, 2006

(30) Foreign Application Priority Data

Oct. 16, 2002 (EP) ..... 02079288

(51) Int. Cl.
*B63B 21/50* (2006.01)

(52) U.S. Cl. ..... 405/224.2; 405/224.3

(58) Field of Classification Search .. 405/224.2–224.4, 405/223.1

See application file for complete search history.

(56) References Cited

U.S. PATENT DOCUMENTS

| | | | | |
|---|---|---|---|---|
| 4,074,541 | A | 2/1978 | Lochridge | |
| 4,182,584 | A | 1/1980 | Hettinger et al. | |
| 4,643,614 | A | 2/1987 | Laursen | |
| 4,695,191 | A * | 9/1987 | Wagstaff | 405/224.2 |
| 6,047,781 | A * | 4/2000 | Scott et al. | 175/5 |
| 6,085,851 | A | 7/2000 | Herrmann et al. | |
| 6,347,912 | B1 | 2/2002 | Thomas | |
| 6,375,391 | B1 * | 4/2002 | Borseth et al. | 405/224.4 |

OTHER PUBLICATIONS

DESERT: "Hybrid rider for deepwater offshore Africa", Offshore Technology Conference, vol. otc, No. 11875, May 1-4, 2000, pp. 1-9, XP002234782 houston, texas cited in the application the whole document.

* cited by examiner

*Primary Examiner*—Frederick L. Lagman
(74) *Attorney, Agent, or Firm*—Young & Thompson

(57) ABSTRACT

A vessel for exploration of hydrocarbons includes one or more risers extending from the vessel to the seabed, a hydrocarbon processing unit connected to the one or more risers and to a storage or transport structure for storing the processed hydrocarbons. The vessel is anchored to the seabed, the vessel includes a lifting member for lowering risers vertically towards the sea bed and for connecting a riser with a first end to a subsea hydrocarbon structure, which riser includes a connector on a second end, the vessel having a connector for attaching to the riser connector and for placing the riser in fluid connection with the processing unit.

20 Claims, 18 Drawing Sheets

66
65'
68'
67'
69'
64'
72
60'
63'
62
71'
55'
54
65
68
53
67
69
64
60
63
71
55
34
73
32

RISER INSTALLATION VESSEL AND METHOD OF USING THE SAME

The invention relates to a vessel for the exploration of hydrocarbons, comprising one or more risers extending from the vessel to the seabed, a hydrocarbon processing unit connected to the one or more risers and a storage or transport structure for the processed hydrocarbons. The invention also relates to a method of installing one or more steel riser pipes.

From Offshore Technology Conference OTC 11875, Houston, Tex., 1-4 May 2000 with the title "Hybrid Riser for Deepwater Offshore Africa", Loïc des Déserts—Doris Engineering, a riser pipe for deep waters is described comprising a steel outer casing with a number of production risers, gas and water injection lines and insulation made of foam which also confers buoyancy to the riser pipe. The riser pipe is assembled on shore and towed to location where it is uprighted and connected to the foundation on the seabed. The upper part of the riser is connected to a submerged buoy. After installation of the hybrid riser pipe, the submerged buoy is connected via flexible jumpers to the surface facility such as an FPSO which may be located at a distance between 70-200 m from the buoy.

The known method has as a disadvantage that during riser installation no hydrocarbon production and/or processing can take place. Furthermore, installation requires special and dedicated installation equipment. Specialised installation vessels are designed to work in as large as possible sea states and are hence, sizeable and costly equipment.

From U.S. Pat. No. 4,182,584 it is known to attach a free-standing marine production riser for use in deepwater between a base portion and a submerged buoy. With a derrick-equipped vessel, such as a semi-sub, the riser casing is lowered through the central part of the buoy and coupled to the bottom until the rigid riser part is completed. Next, a flexible hose is attached to a surface facility for hydrocarbon production and processing.

Again, the use of separate vessels for riser installation and for hydrocarbon production/processing requires scheduling and mobilising the installation vessel to site at large day rates and the demobilisation of the installation vessel after installation of the riser.

Furthermore, in view of the large costs of the installation vessel, as many risers as possible would be installed when the installation vessel is on site, which implies capital outlay, fatigue and maintenance of the risers which are not producing.

It is hence an object of the present invention to provide a flexible system for riser installation and hydrocarbon production and/or processing, avoiding complex scheduling of the installation vessel and allowing riser installation at a suitable moment.

It is a further object of the present invention to provide a flexible riser installation method using relatively simple installation equipment.

It is another object of the present invention to provide a riser installation method in which during hydrocarbon production and/or processing additional risers can be rapidly installed.

Hereto, the vessel according to the present invention is characterised in that the vessel is anchored to the seabed, the vessel comprising a lifting means for lowering risers vertically towards the sea bed and for connecting a riser with a first end to a subsea hydrocarbon structure, which riser comprises a connector on a second end, the vessel comprising a connector for attaching to the riser connector and for placing the riser in fluid connection with the processing unit.

With the vessel of the present invention, no dedicated expensive riser installation vessels need to be used. By installing the risers from the vessel, it is possible to start hydrocarbon production and processing while at the same time installing the risers during stable weather conditions. The vessel of the present invention allows hydrocarbon production while obtaining information from the hydrocarbon field. When after start of hydrocarbon production it is required to drill and connect other nearby wells, this can be carried out simply from the installation equipment on the vessel.

The processed hydrocarbons may be stored in tanks on the vessel and transported to shore via shuttle tankers or may be transported via a pipeline from the vessel to another vessel or to an on-shore installation.

The means for lowering the risers may comprise a lifting device of the type such as described in European patent application number 02075311.7 which was filed on 25 Jan. 2002 in the name of the applicant. The lowering equipment described herein is relatively simple and takes up little deck space leaving sufficient room for hydrocarbon production and/or processing equipment.

In a preferred embodiment, the risers are extending alongside of the vessel. The vessel may comprise a derrick and a drill string extending to the seabed, such as through a moon pool in the vessel.

The risers may comprise a lower rigid (steel) part and may be connected to a submerged buoy, the upper part of the risers being made of a flexible material and extending from the buoy to the vessel. The vessel may be spread moored whereas the risers may be installed through a central shaft in the vessel according to another embodiment.

Some embodiments of a method according to the present invention will be described in detail with reference to the accompanying drawings, In the drawings.

Figure 1:
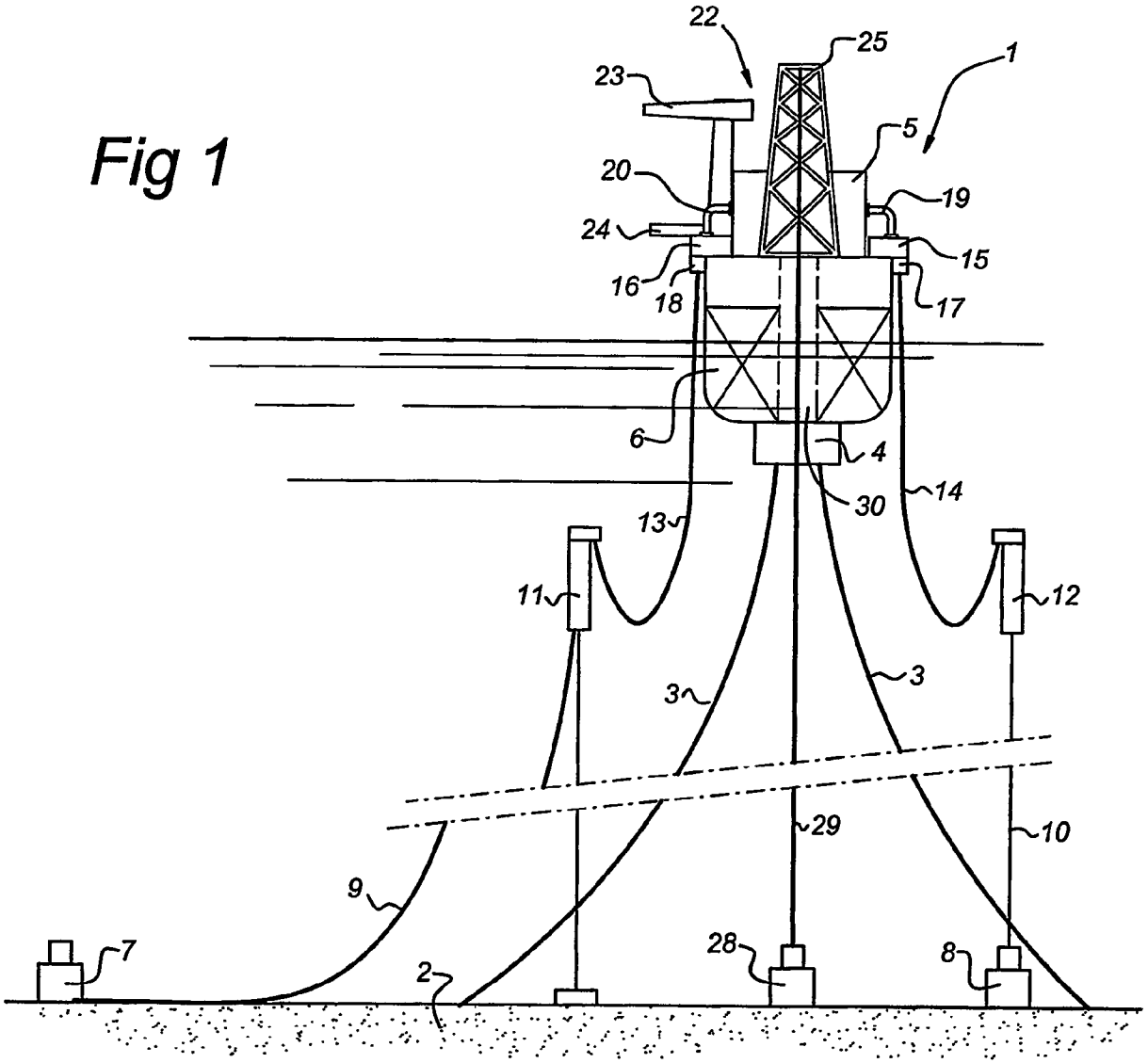
FIG. 1 shows a schematic view of a hydrocarbon production and/or processing vessel for carrying out the method of the present invention.

FIG. 1 shows a hydrocarbon production and/or processing vessel 1 according to the present invention. The vessel 1 may be connected to the seabed 2 via a number of anchor lines 3 which may be connected to a chain table 4 provided at the bottom of the vessel 1. Alternatively, other configurations, such as a turret moored or a spread moored configuration, are also possible.

The vessel 1 comprises a hydrocarbon-processing unit 5, such as oil and water separation systems, gas liquefaction equipment, a regassification plant, etc. Storage tanks 6 in the vessel 1 may contain crude and/or processed hydrocarbons.

From wellheads 7, 8 on the seabed 2, lower riser parts 9, 10 extend to submerged buoys 11, 12. From the buoys 11, 12 flexible risers 13, 14 extend to connectors 15, 16 on the vessel 1. Each riser 13, 14 comprises at its upper end a connector 17, 18 which attaches to connectors 15, 16 to place risers 13, 14 in fluid connection with the processing unit 5 and/or hydrocarbon storage tanks 6, via ducts 19, 20.

On deck of the vessel 1, a lifting means 22 is provided having an upper lifting arm 23 and lower lifting arm 24 which can be moved in a vertical direction towards and away from each other. In case the vessel 1 is a FPDSO, on deck of the vessel 1, a derrick 25 may be placed for drilling of a new well 28, a drill string 29 extending through a shaft 30 in the vessel 1.

Figure 2:
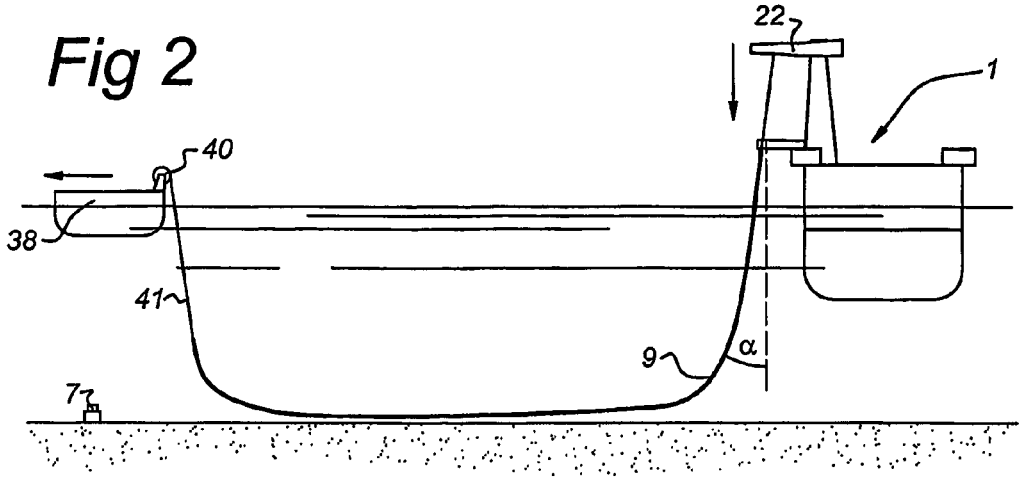
FIGS. 2-4 show the sequence of horizontal extension of a riser, hook-up of the riser to a sub sea wellhead and connection to the vessel.

FIG. 2 shows the steel catenary riser (SCR) 9 being with its upper end connected to the lifting means 22 and extending at an angle $\alpha$ of 2°-10° with the vertical. The work vessel 38 pulls out the riser 9 via a winch 40 and chain or cable 41 connected to the lower end of the riser 9, over the sea bed, to the well head 7 or to a well head connection, such as a manifold and the like. Instead of a work vessel 38 for pulling the riser 9, it may be pulled to the well head 7 by a moored vessel using a winch. The chain or cable 41 preferably has a similar linear weight (kg/m) as the riser 9 in water, such that the riser 9 and chain or cable 41 follow the same catenary curve hence avoiding moments exerted on the pipe and consequent damage to the riser 9. This is especially relevant for deep waters, such as water depths of 500 m and deeper, for instance between 1000 and 2000 m.

Figure 3:
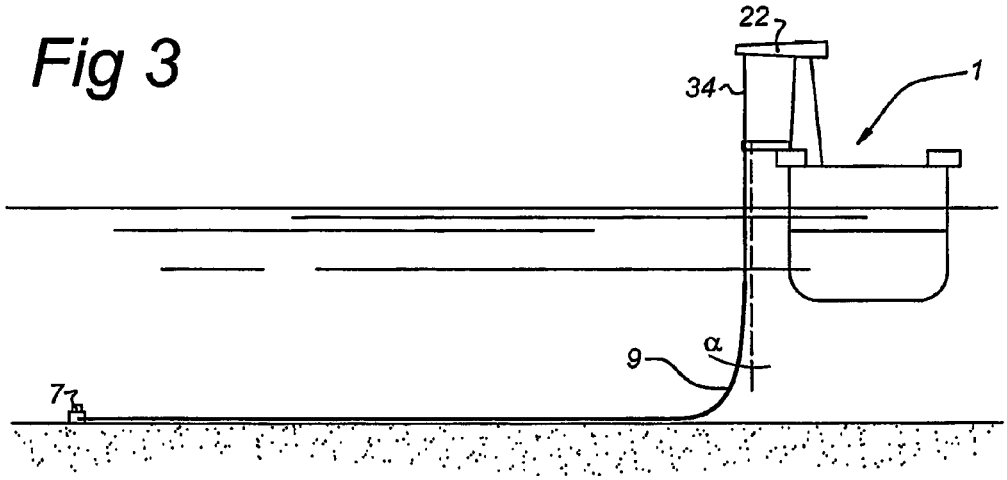

As shown in FIG. 3, the upper end of the riser 9 is connected to the lifting means 22 via a chain or cable 34 at the moment when the lower end of the riser 9 is situated near the well head 7, wile the work vessel 38 continues to drag the riser 9 over the sea bed towards the well head 7. When the lower riser end has reached the well head 7, the riser is lowered from the work vessel 38 and is connected to the well head via a remotely operated vehicle (ROV), not shown in the drawing. The chain or cable 41 is disconnected from the riser by the ROV.

Figure 4:
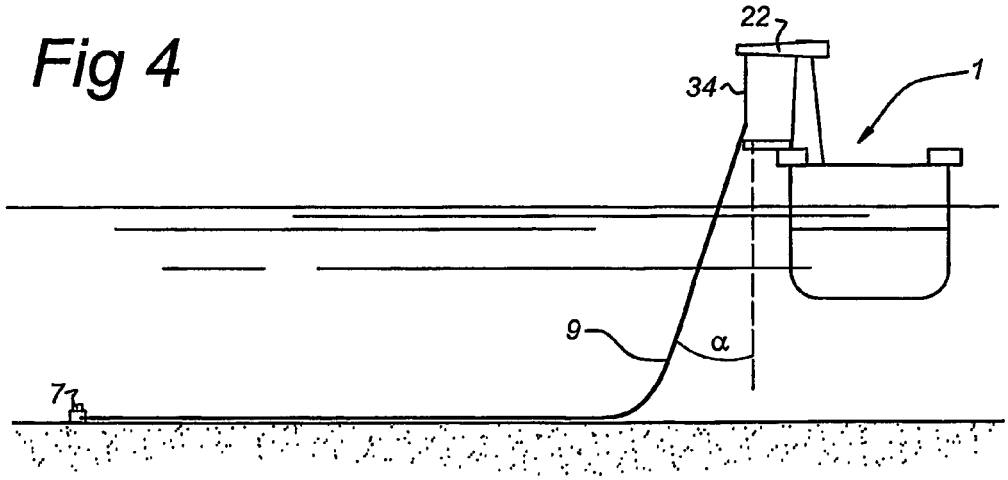
Figure 6:
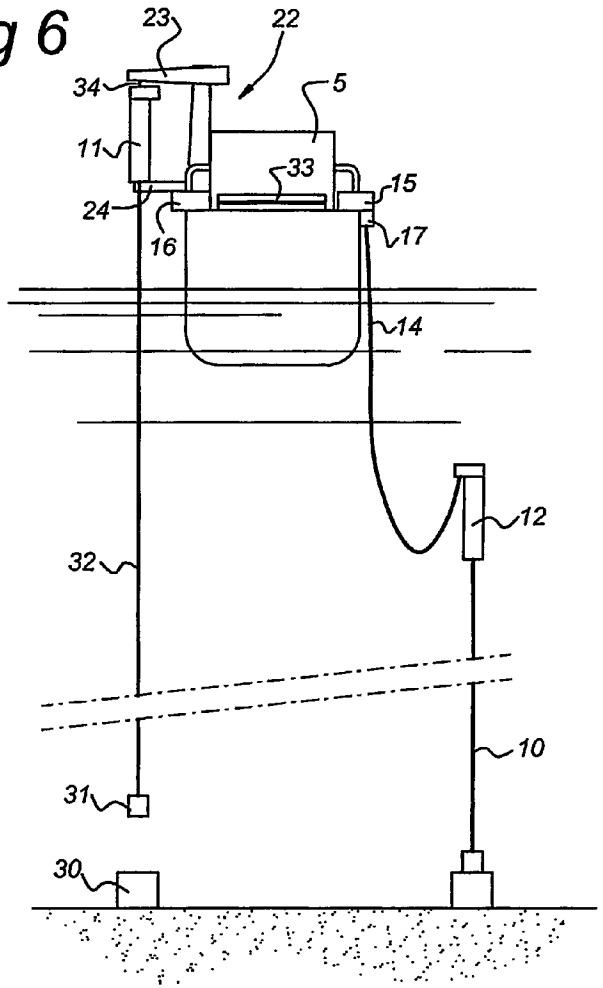
FIGS. 5-8 show another method of riser installations according to the present invention.
Figure 5:
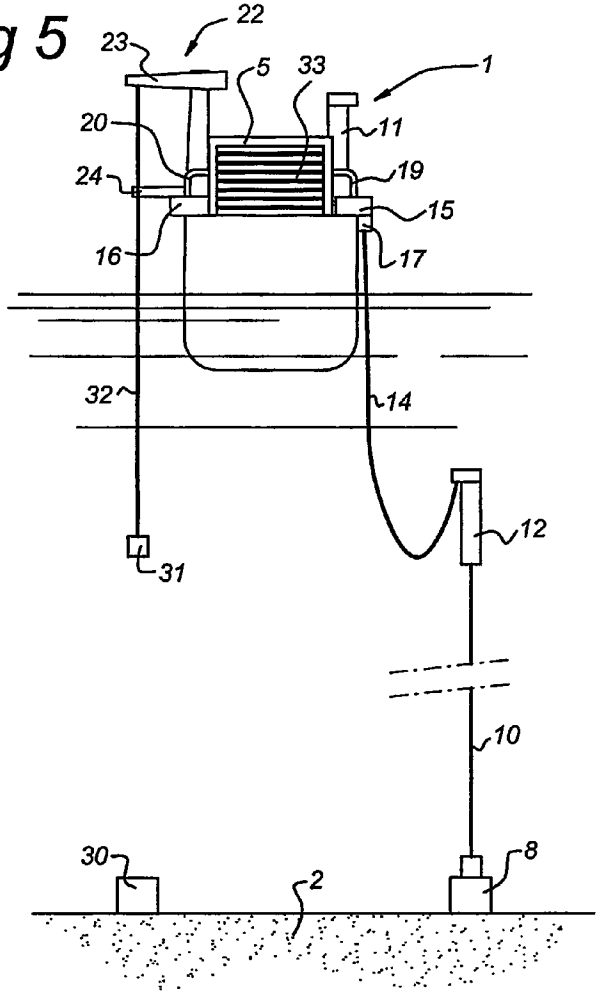
Figure 8:
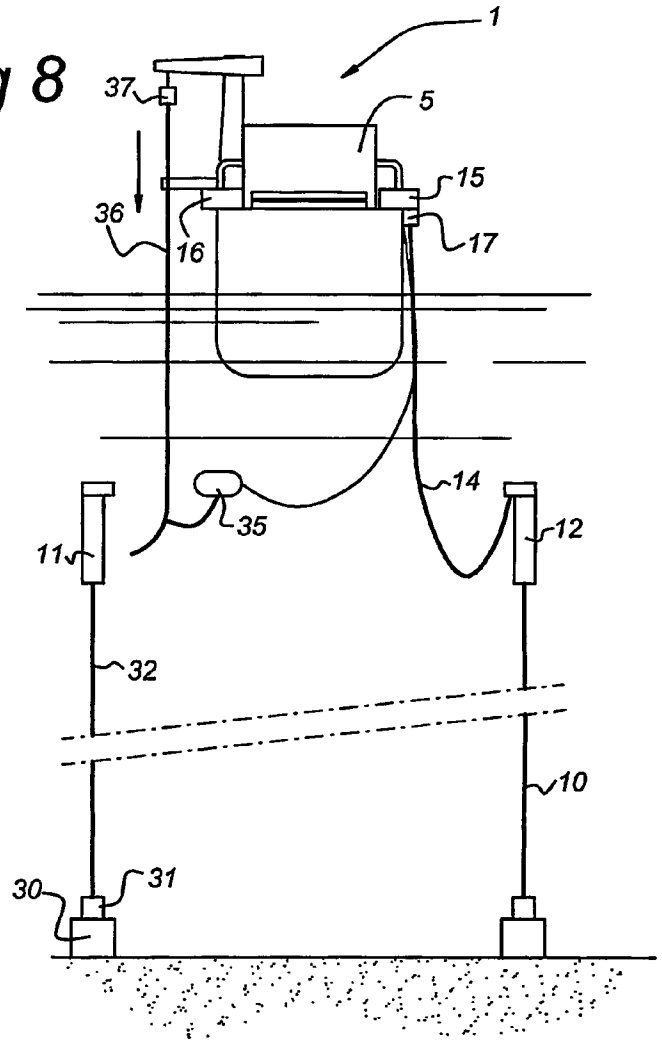
Figure 7:
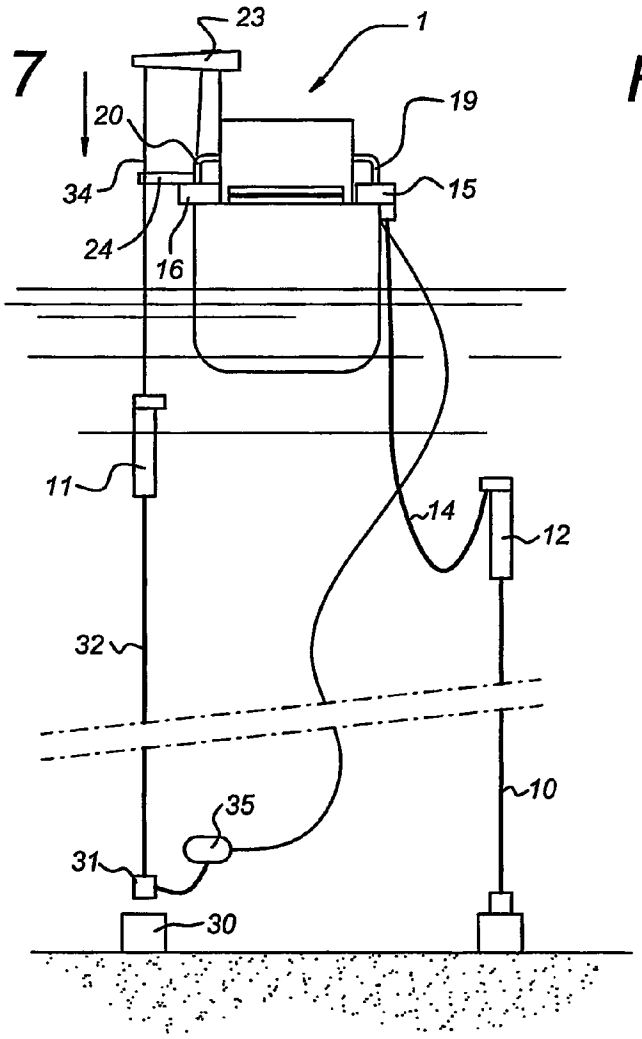

Next, as is shown in FIG. 4, the chain or cable 34 is pulled upward, so that the riser will have an inclination of about 15°-20° with respect to the vertical. With this angle of inclination, the riser 9 is connected to the vessel for transport of hydrocarbons from the well head 7 to the vessel.

FIGS. 5-8 show the process of installing a rigid riser part 32 having a connector 31 at its lower end to stab onto a wellhead 30 on the seabed 2. The riser 32 is assembled from segments 33, which may be stored on the vessel 1. The riser 32 is lowered via the lifting device 22 by releasing a clamping mechanism of the lower arm 24 and lowering upper arm 23. Next, the clamping mechanism on the lower arm 24 is engaged with the top part of the risers 32, the clamping mechanism on the upper arm 23 is released and the upper arm 23 returns to its upward position. Another segment 33 is clamped in the upper arm 23 and is connected to the riser section depending from lower arm 24 and the lowering cycle is repeated. A riser supporting buoy 11 may be stored on the vessel and is attached to the top of riser 32, as is shown in FIG. 3. At the position of the lifting device 22, the upper part of the buoy 11 may be connected to the upper arm 23. As shown in FIG. 4, the buoy 11 is lowered from a cable 34 whereas a remotely operated vehicle 35 is operated from the vessel to attach connector 31 to the wellhead 30. After attaching the connector 31 buoyancy is added to buoy 11 and the remotely operated vehicle 35 is operated to attach a flexible riser 36 with its lower end to the buoy 11 to be in fluid connection with riser 32 and with connector 37 at its upper end to connector 16 on the vessel 1 to be in fluid communication with processing unit 5.

Figure 9:
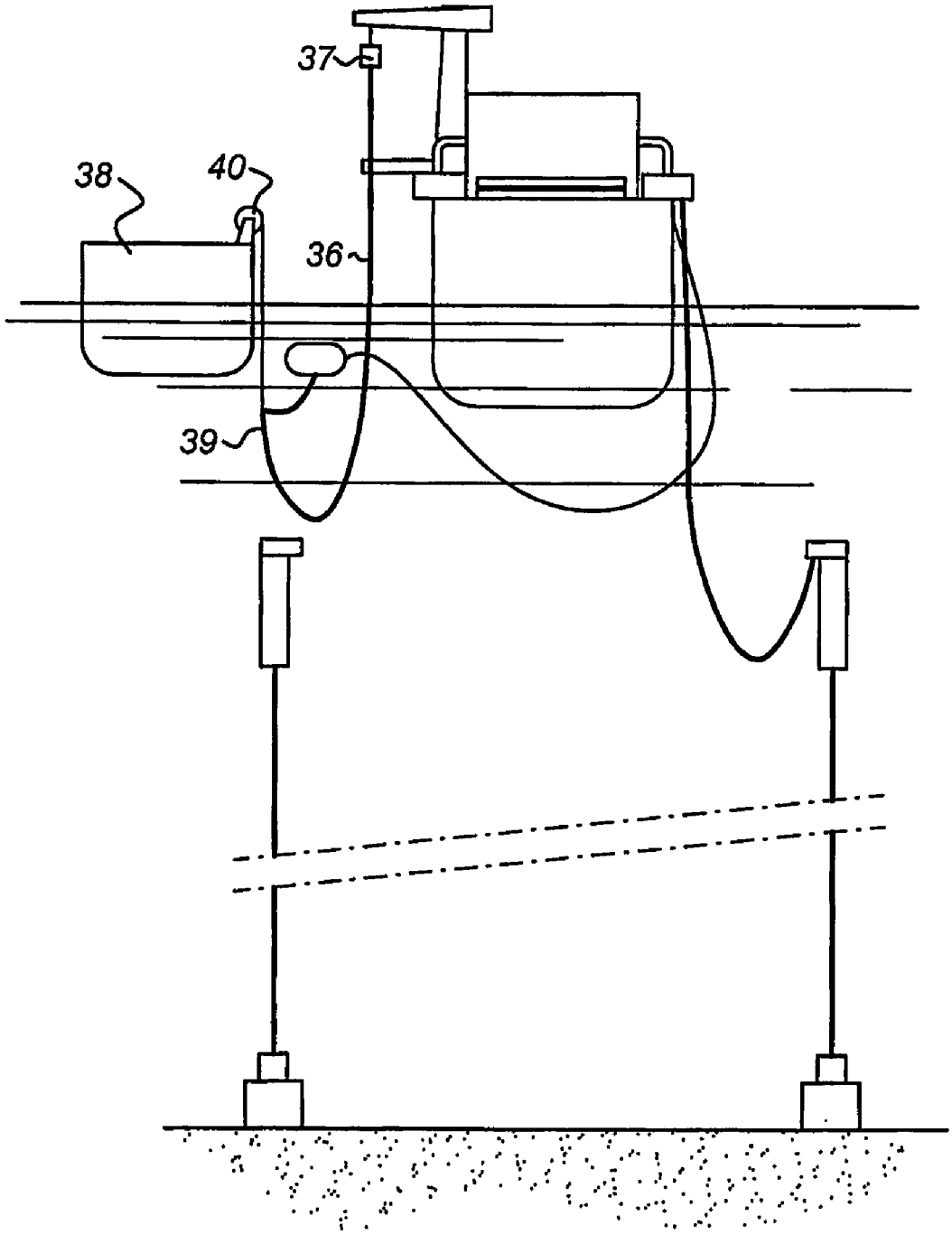
FIG. 9 shows an alternative method of riser installations according to the present invention employing a work vessel.

In the embodiment as shown in FIG. 9, a smaller vessel or tugboat 38 assists in lowering the lower end 39 of flexible riser 36 via a winch 40.

Figure 10:
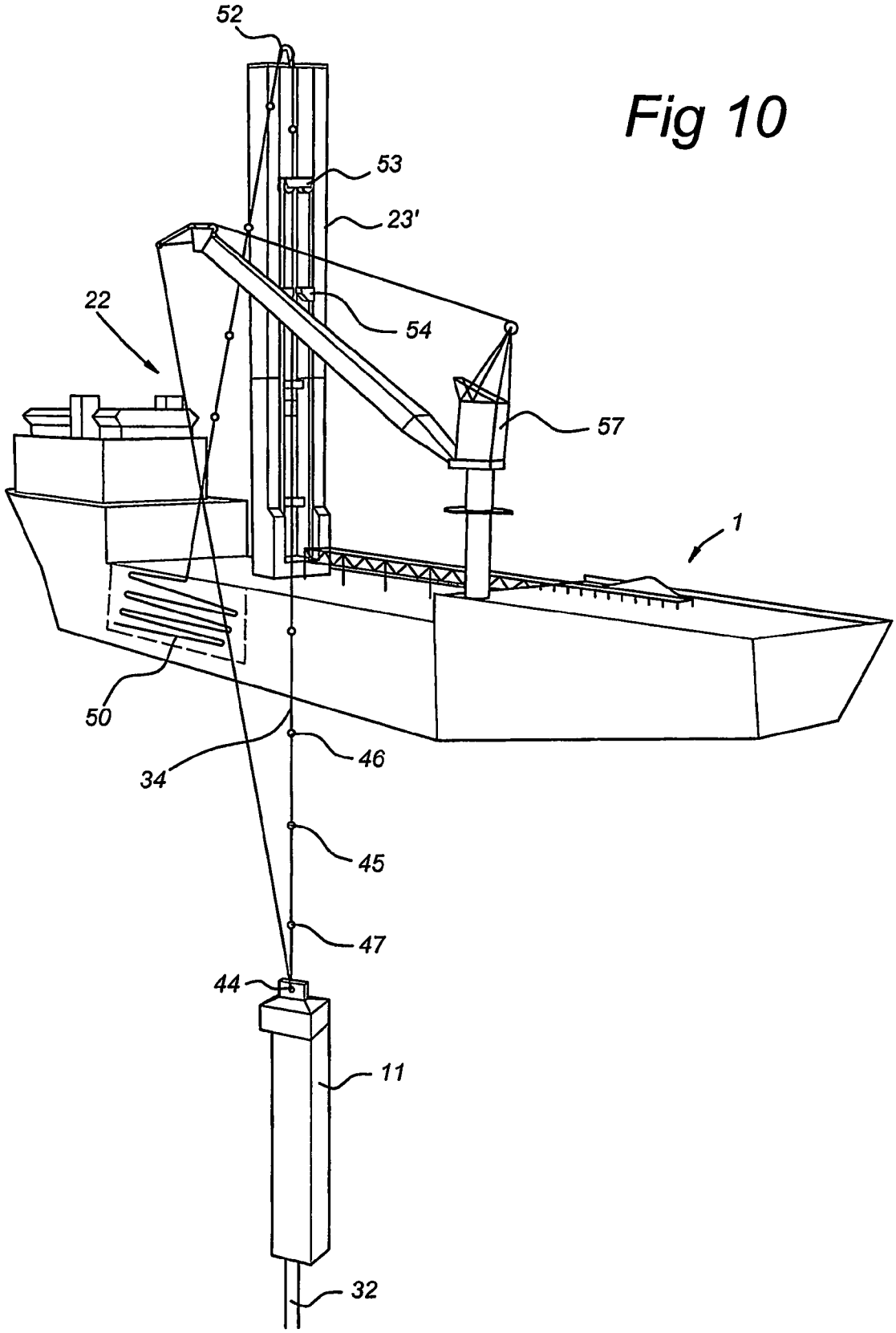
FIG. 10 shows an embodiment of a vessel and a lifting device for carrying out the method of the present invention.

FIG. 10 shows the vessel 1 comprising the lifting device 22 according to the present invention. The lifting device 22 comprises a vertical frame 23' carrying the cable 34 having at spaced-apart locations support members in the form of broadened parts 45, 46, 47. At the end of the cable 34, a connector 44 is provided that is attached to the buoy 11, which is being lowered via the cable 34. The cable 34 is stored in a looped configuration in a storage compartment or hawse-hole 40, substantially without being tensioned. From the storage compartment 40, the cable 34 is guided via a sheave 52 to an upper lifting structure 53 and a lower lifting structure 54. The upper lifting structure can travel up and down along the vertical frame 23' and can releasably engage with the broadened parts 45, 46, 47 on the cable 34. Stationary lower lifting structure 54 can also engage and be disengaged with the broadened parts 45, 46, 47. By the lower releasing lifting structure 54 and lowering the cable suspended from upper lifting structure 53, the buoy 11 is lowered. After lowering of the upper lifting structure 53 by a certain amount, the lower lifting structure 54 is engaged with one of the broadened parts of the cable 34, whereas the upper lifting structure 53 disengages from the cable and is returned to its upper position. In this way, the buoy 11 can be successively lowered until it reaches its desired depth. The buoy 11 may, prior to being lowered from lifting device 22, be placed overboard by a crane 57, which is thereafter disengaged such that the buoy can be lowered from cable 34.

As an alternative to the looped configuration, the cable 34 may also be stored in the compartment 50 in a coiled from, for instance around a conical raised bottom part of compartment 50, or be stored on a drum or, again, alternatively as separate line sections.

Figures 11, 12, 13:
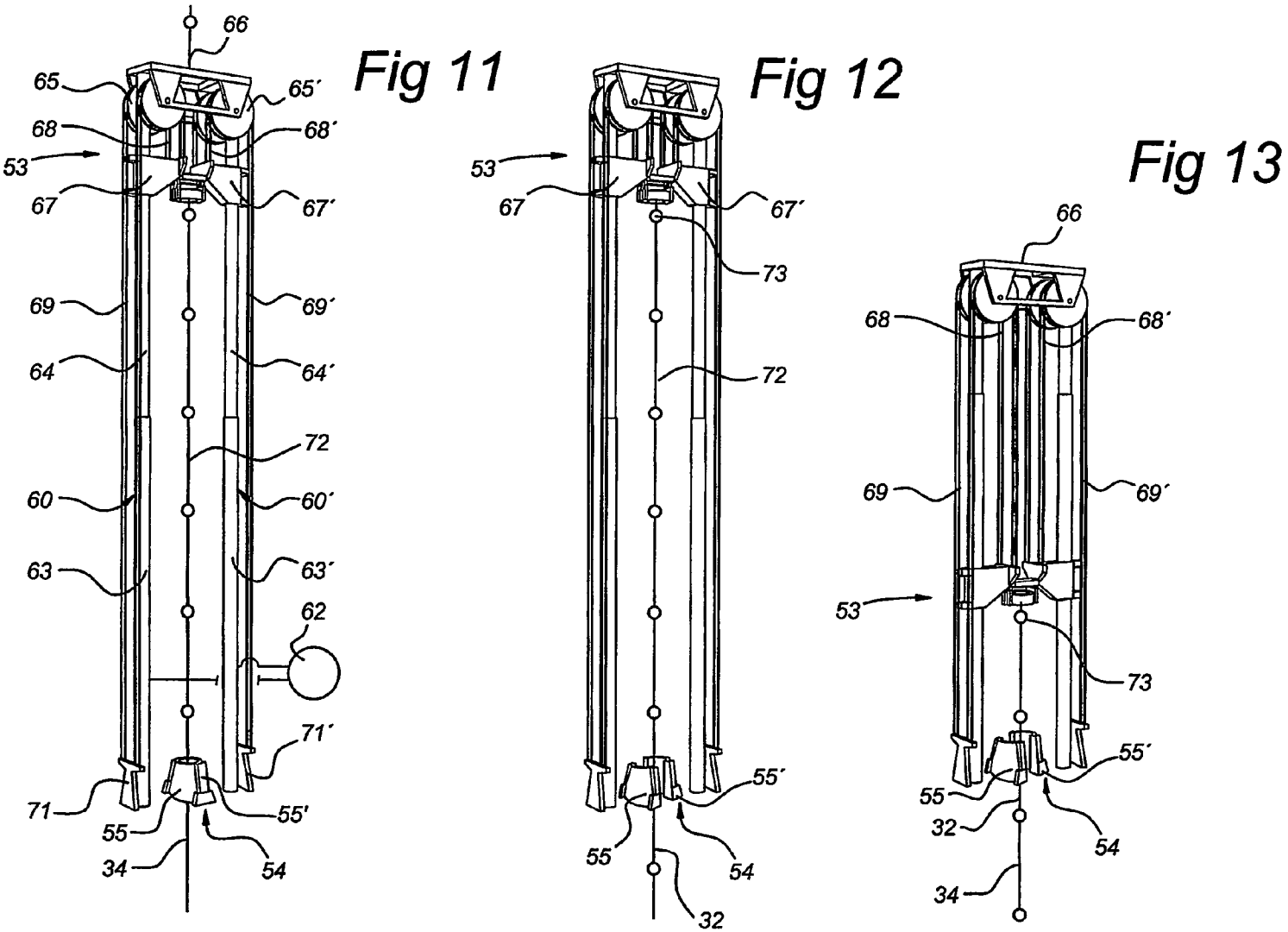
FIGS. 11-13 show a detailed view of the lifting device of FIG. 10.

FIG. 11 shows a detailed view of upper and lower lifting structures 53, 54. The upper lifting structure 53 comprises two parallel cylinders 60, 60', which are powered by hydraulic pump 62. Each cylinder comprises a sleeve 63, 63' and a rod 64, 64' moveably received within the sleeve 63, 63'. At the end of each rod 64, 64' a pulley 65, 65' is connected. Both pulleys are interconnected via a frame 66. A moveable clamp 67, 67' is slidably connected along each rod 64, 64' and along each sleeve 63, 63'. The clamps 67, 67' are connected to the end part of a cable having a first cable section 68, 68' extending from the pulley 65, 65' to the respective clamp 67, 67' and a second cable section 69, 69' extending along the rod 64, 64' and sleeve 63, 63' to a fixed position 71, 71'. As shown in FIG. 11, the lower lifting structure 54 is clampingly engaged via clamps 55, 55' with a part of the cable 34. An upper cable section 72 is engaged with clamps 67, 67' of upper lifting structure 53, such as shown in FIG. 12. Thereafter, the clamps 55, 55' of the lower lifting structure 34 are opened, while upper clamps 67, 67' remain engaged with the broadened part on the upper cable section 72. Under control of the hydraulic pump 62, the rods 64, 64' are under the weight of the cable 34 and buoy 11 and riser 32, pulled into sleeves 63, 63' such that the clamps 67, 67' descend along the sleeves 63, 63'. In the lowered position, such as shown in FIG. 13, the clamps 55, 55' engage with a broadened part of cable section 34. Hereby, the whole cable weight and the weight of the buoy 11 and riser 32 are again supported from the lower lifting structure 54. The clamps 67, 67' are then disengaged and the pulleys 65, 65' are returned to their upper position as shown in FIG. 11. In an advantageous embodiment, the lifting structures 53, 54 are formed as an integral unit in a frame, which is suspended from the crane 57. In this way, heavy loads can be handled at large water depths from vessels having a standard crane by the lifting device of the present invention.

Instead of a lifting means as shown in FIGS. 11-13, a heave-compensated winch could be used.

Figure 15:
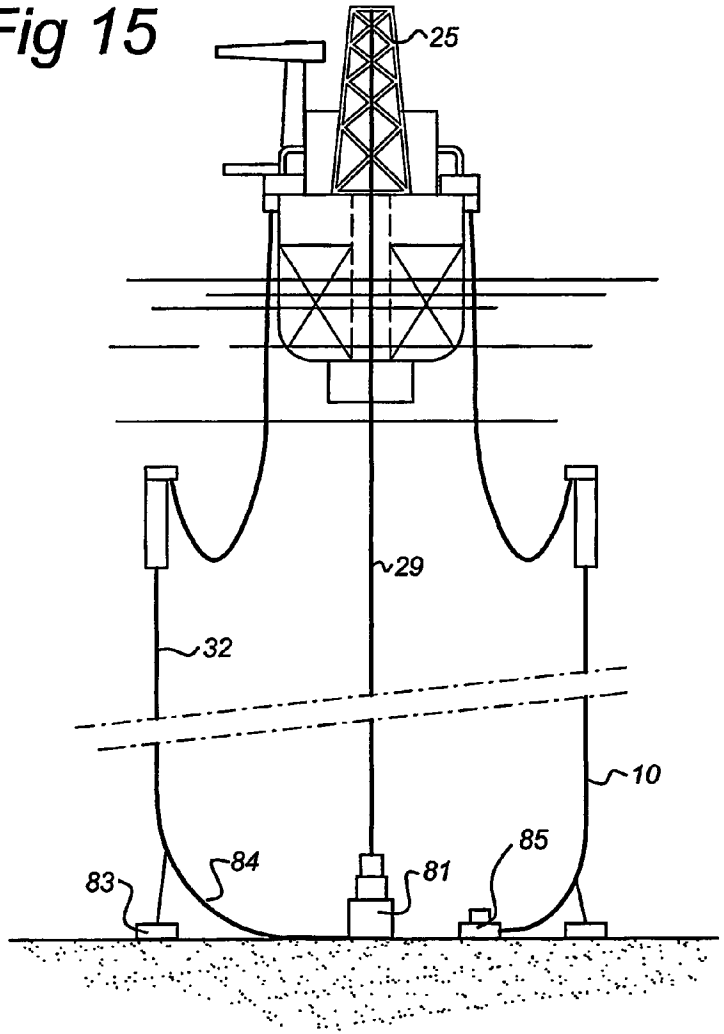
FIGS. 14-15 show a riser configuration installed by the method of the present invention.
Figure 14:
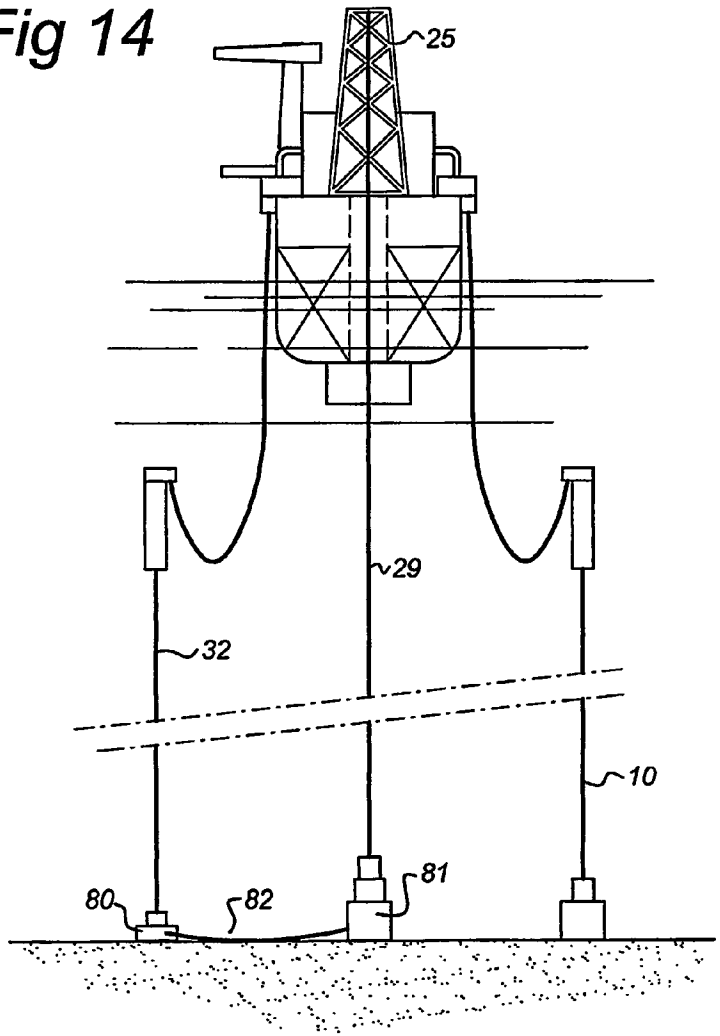

FIG. 14 shows a riser configuration installed according to the present invention in which a connector base 80 is attached to vertical riser 32, which connector base 80 is connected to a wellhead 81 via a horizontal bottom pipe 82. In the embodiment of FIG. 15, the riser 32 is connected via a J-curved section 84 to the wellhead 81 and is being tensioned to the seabed via tensioning base 83. Alternatively, the riser 10 may be connected to a connector base 85 in a J-curved manner, similar to riser 32. After completion of the drilling operation, the drilling riser 29 and the derrick 25 may be removed.

Figure 16:
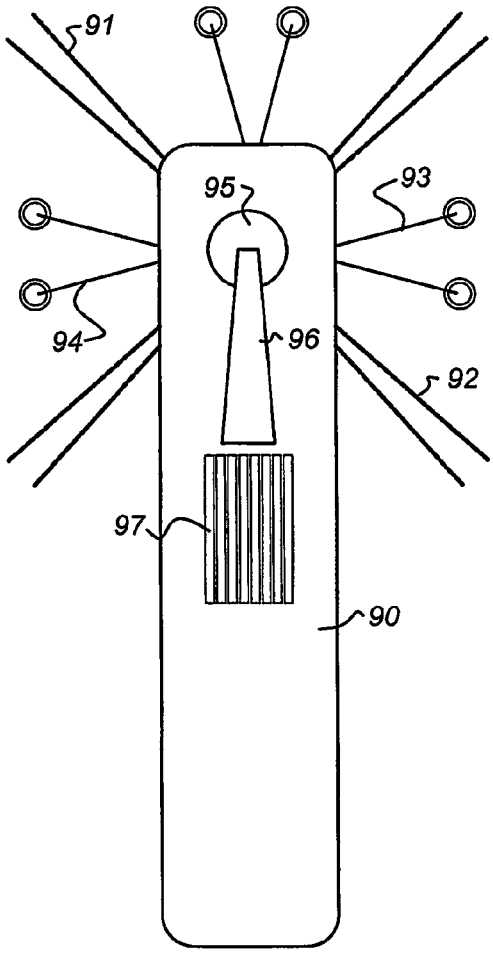
FIGS. 16-17 show a vessel having a turret moored configuration carrying risers that have been installed according to the present invention.

FIG. 16 shows a turret moored vessel 90 in which anchor lines 91, 92 are with one end attached to a turret 98 and with another end to the seabed. Risers 93, 94 are connected to a hydrocarbon processing unit on the vessel. Through a lifting means 96, riser sections 97 are lowered from the deck of the vessel 90 through a central shaft 95 in the turret 98 to be attached to a subsea wellhead.

Figure 17:
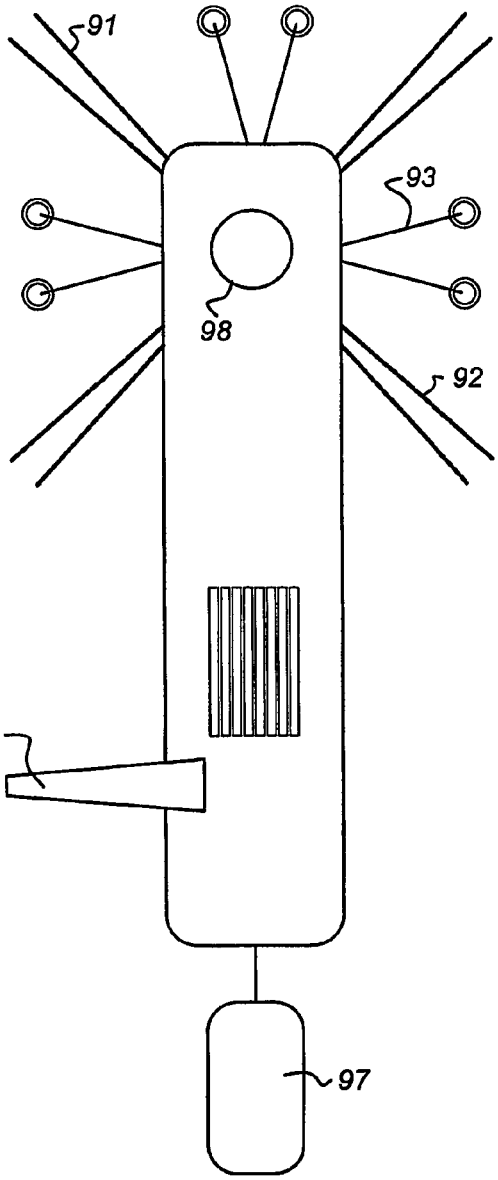

In the embodiment shown in FIG. 17, a turret-moored barge is shown in which the lifting device 96 is placed at the side of the vessel. Via a small tug 97, the riser installation may be assisted.

Figure 18:
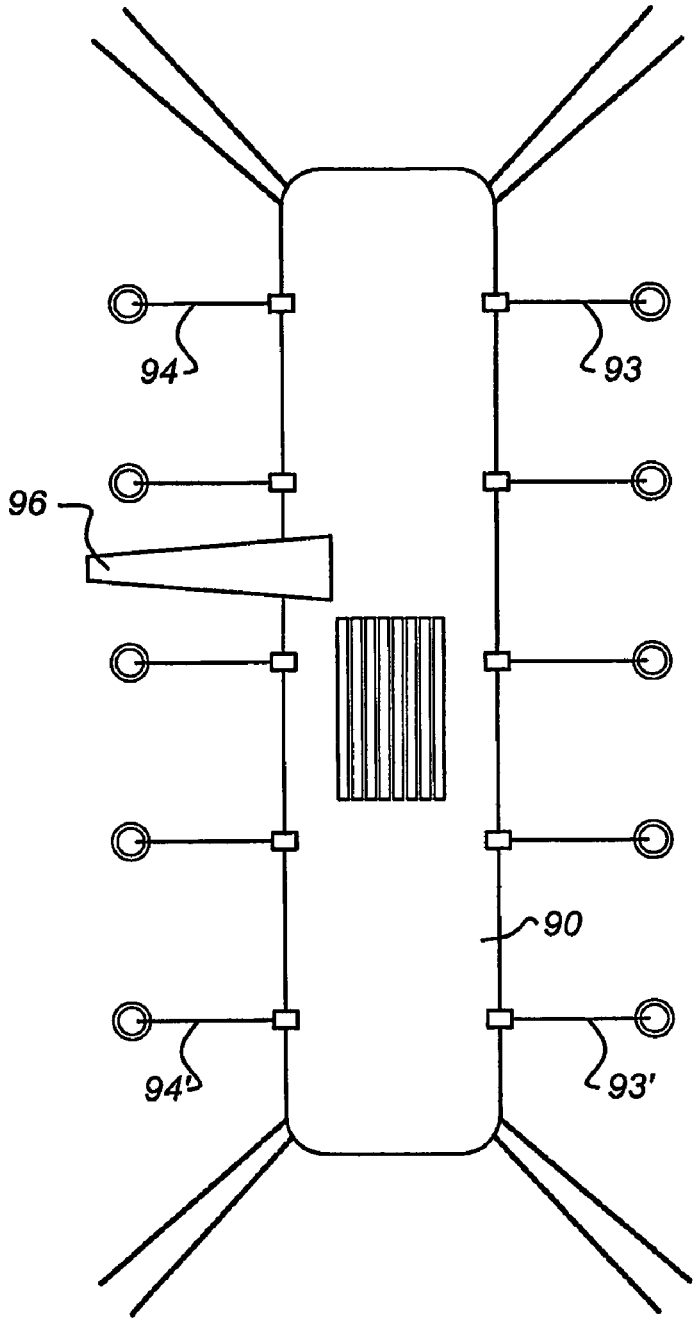
FIG. 18 shows a spread-moored anchoring configuration of a vessel carrying risers according to the present invention.
Figure 20:
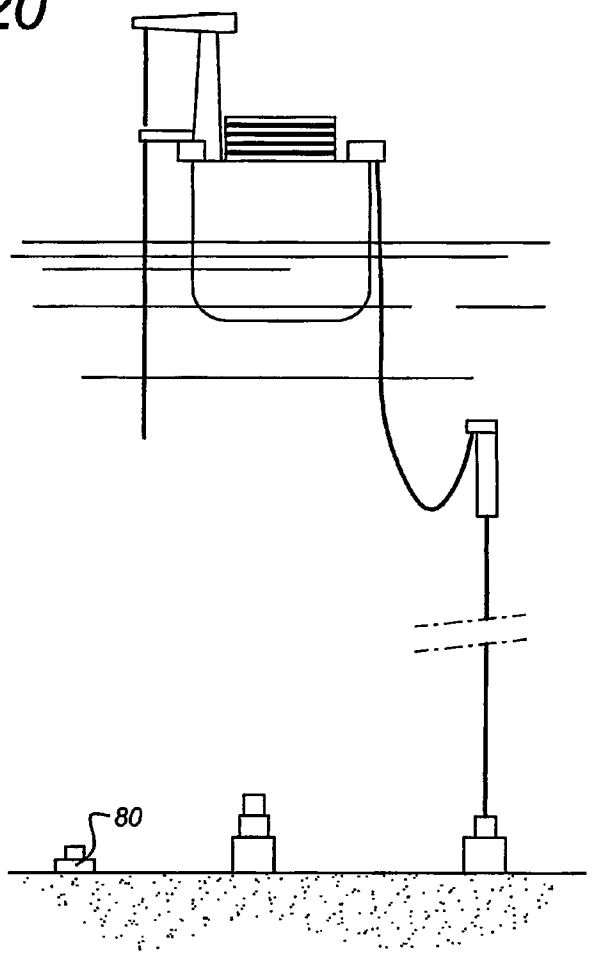
FIGS. 19-22 show a schematic view of a further embodiment of a method according to the invention.
Figure 19:
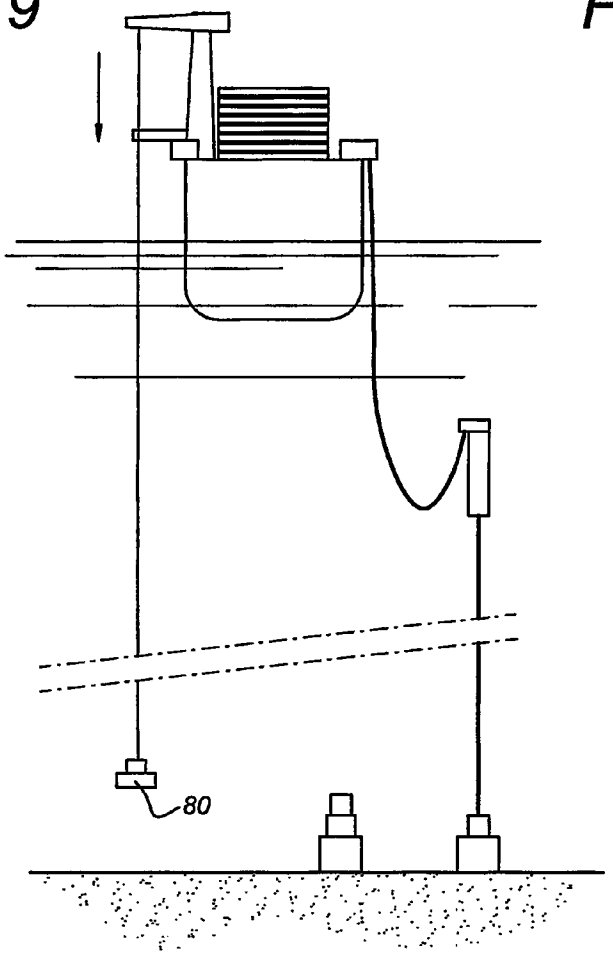
Figure 22:
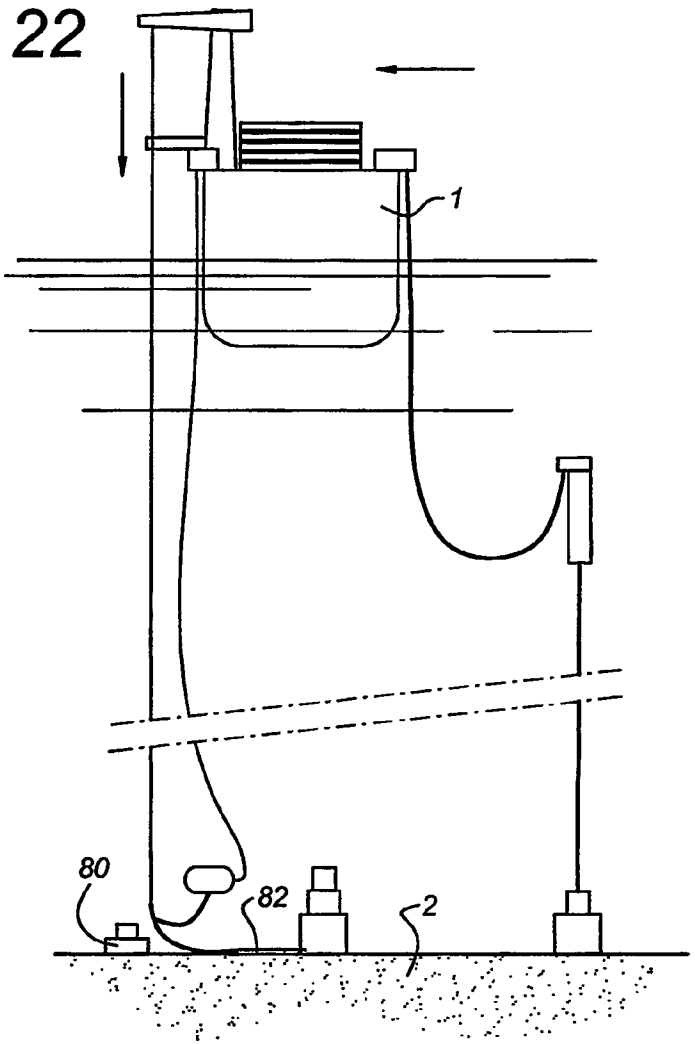
Figure 21:
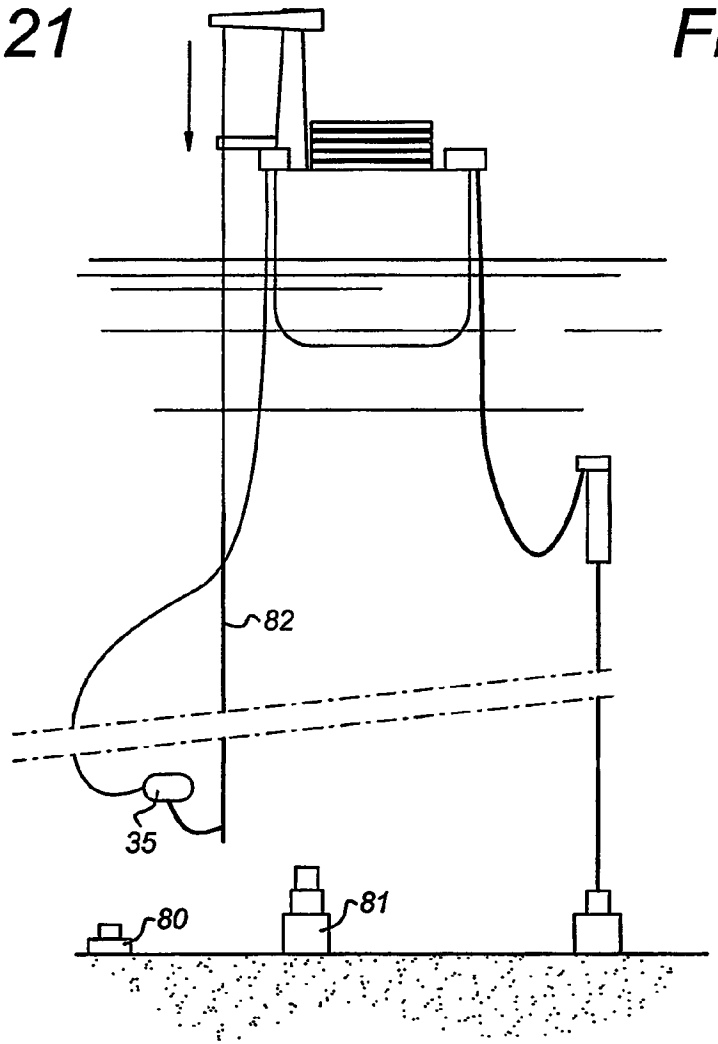

FIG. 18 shows a spread-moored configuration in which the risers 93, 93', 94, 94' are placed at the regularly spaced positions on the sides of the vessel, and are after lowering from crane 96 and attached to a buoy, towed in position by a mall tugboat.

FIGS. 19-22 show a method of riser installation in which first a connector base 80 is lowered onto the seabed. Via ROV 35 a first end of riser 82 is connected to wellhead 81 whereafter the vessel 1 is moved towards connector base 80 for connection of the other end of riser 82, such that bottom pipe 82 extends substantially horizontally on the seabed 2. In the next steps, a vertical riser part, a buoyancy member and flexible riser such as shown in FIG. 14 may be installed.

Figure 23:
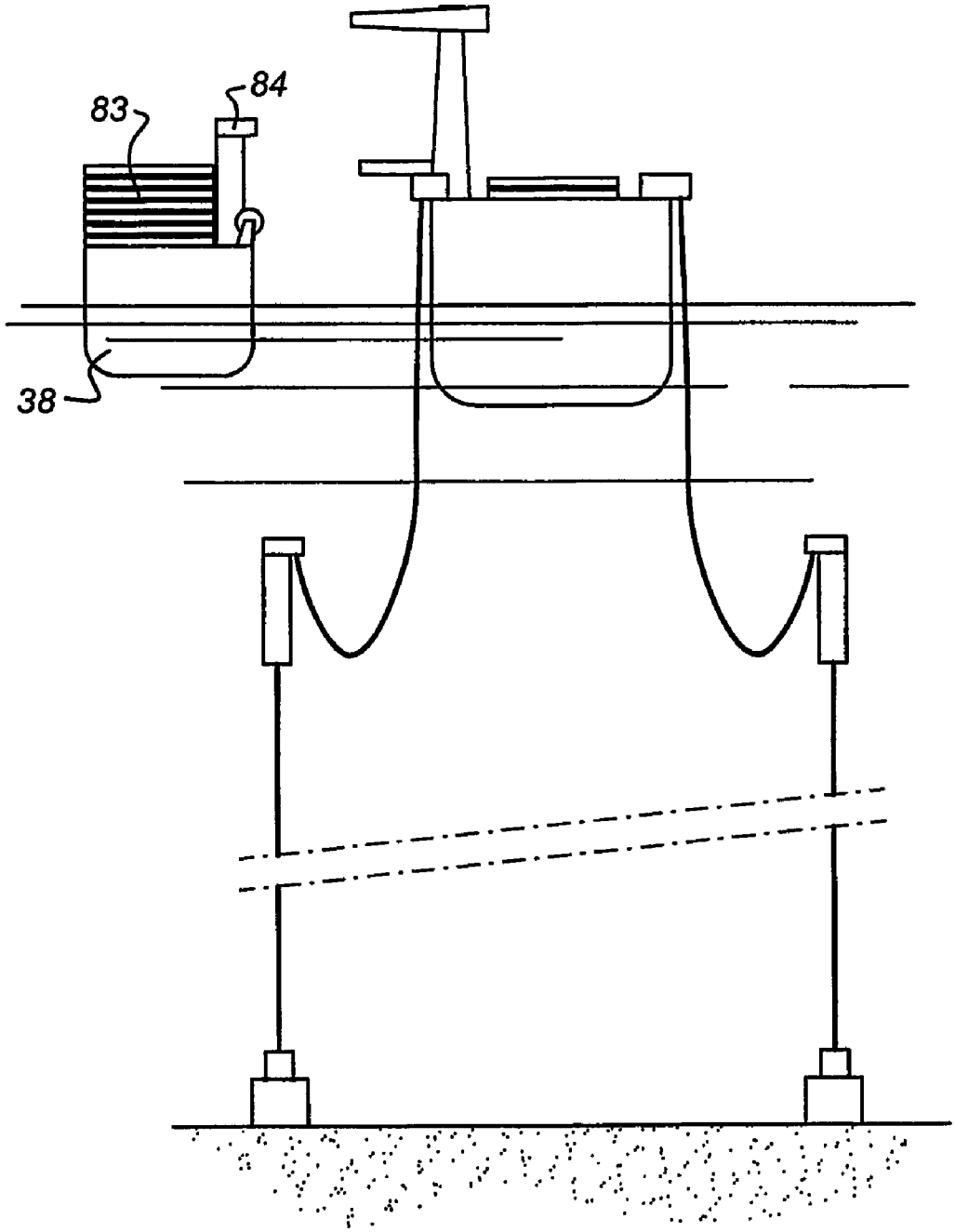
FIG. 23 shows an embodiment of the method using a separate working vessel.
Figure 25:
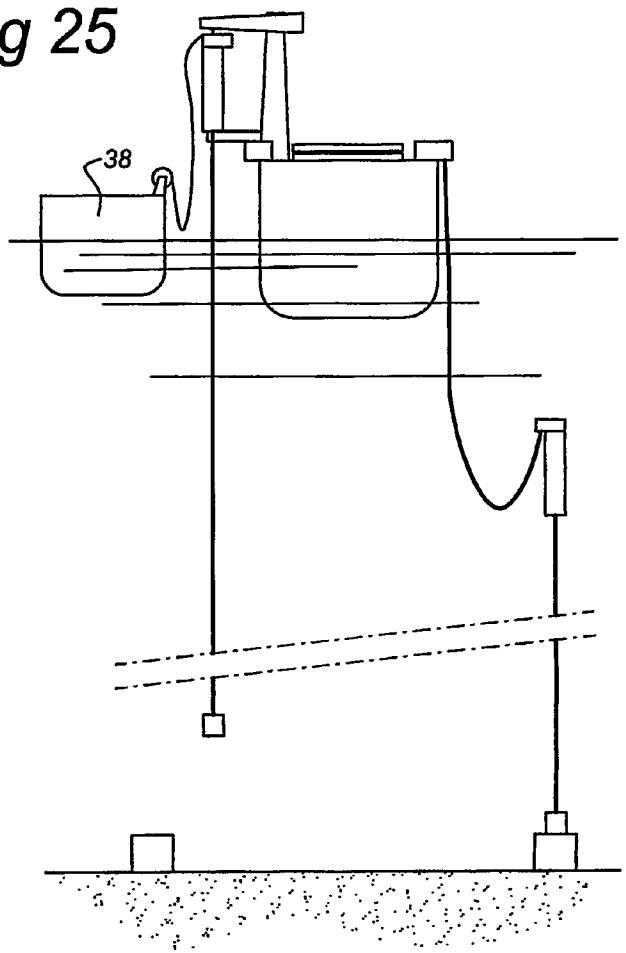
FIGS. 24-30 show a riser installation method using a separate work vessel.
Figure 24:
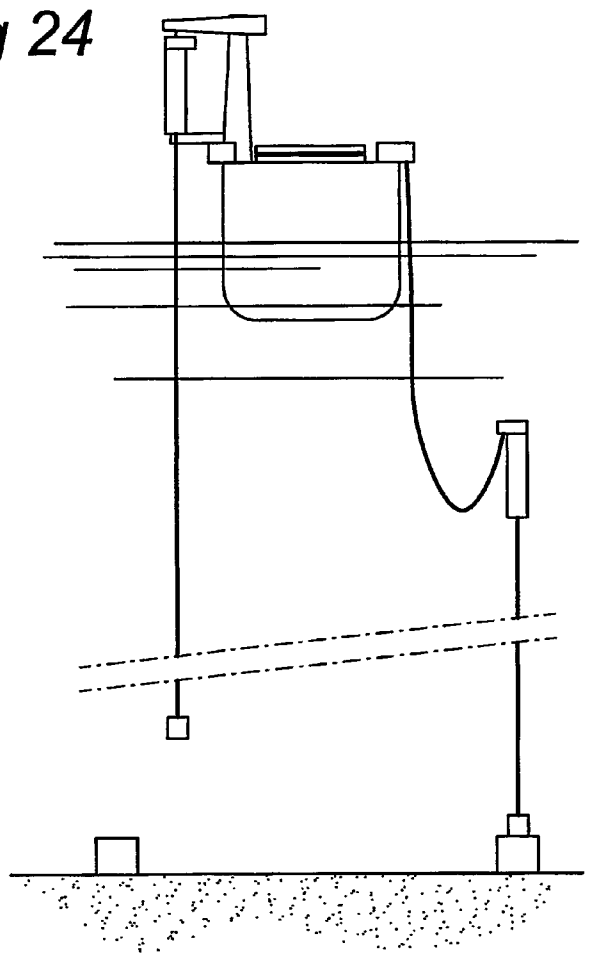
Figure 27:
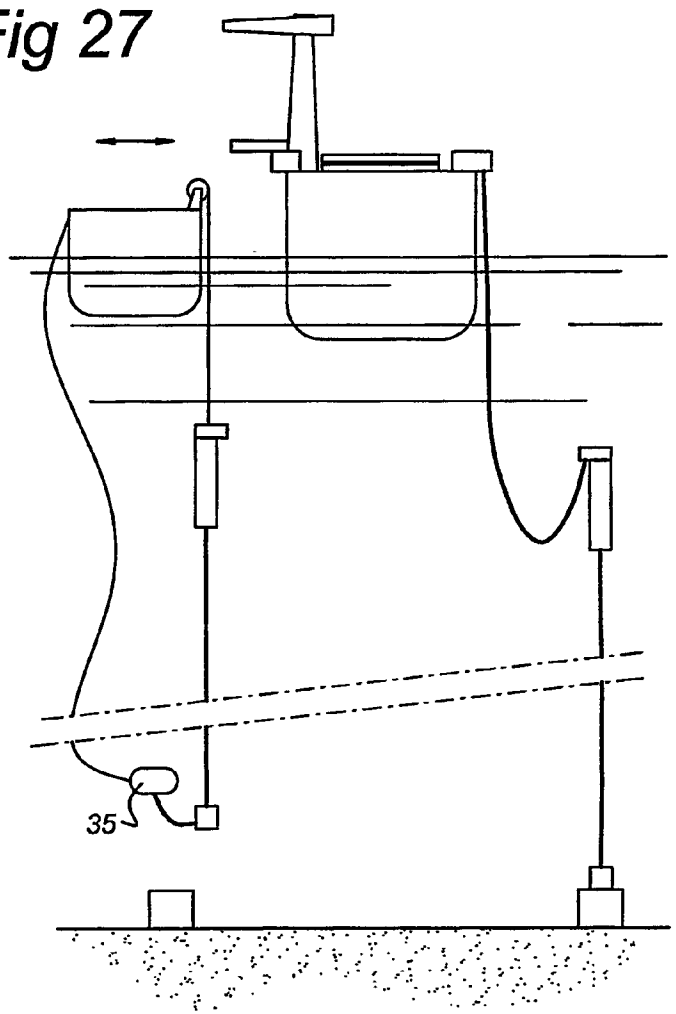
Figure 26:
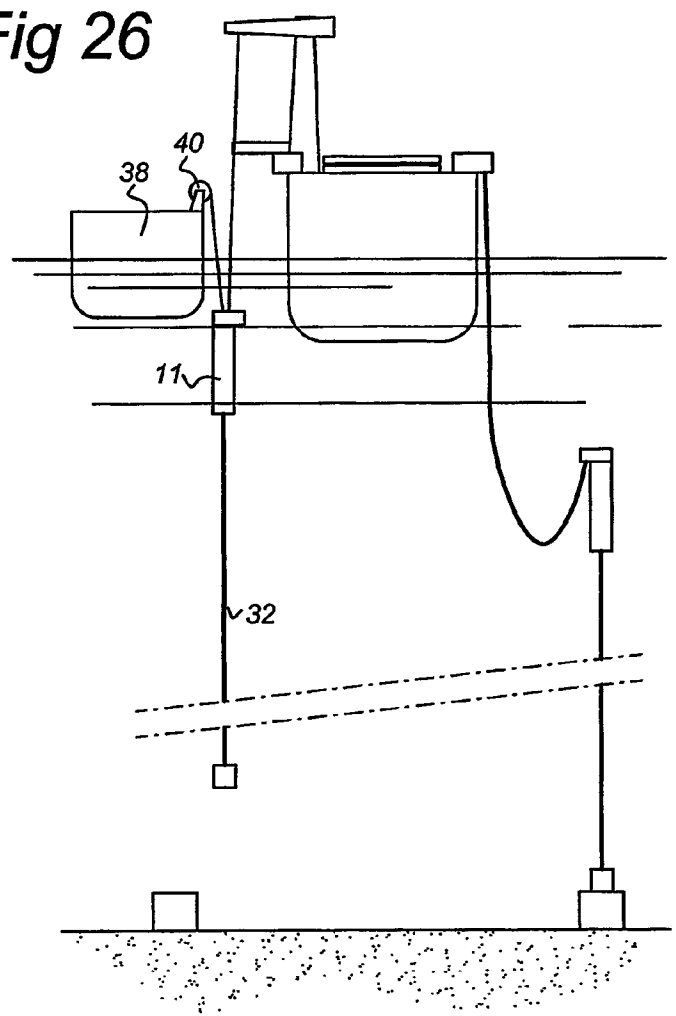
Figure 29:
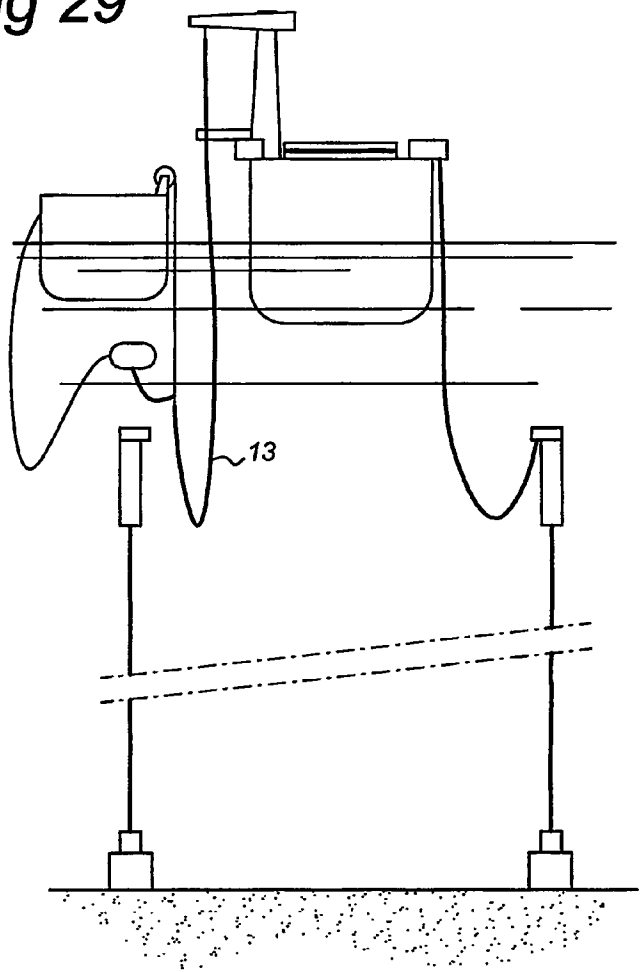
Figure 28:
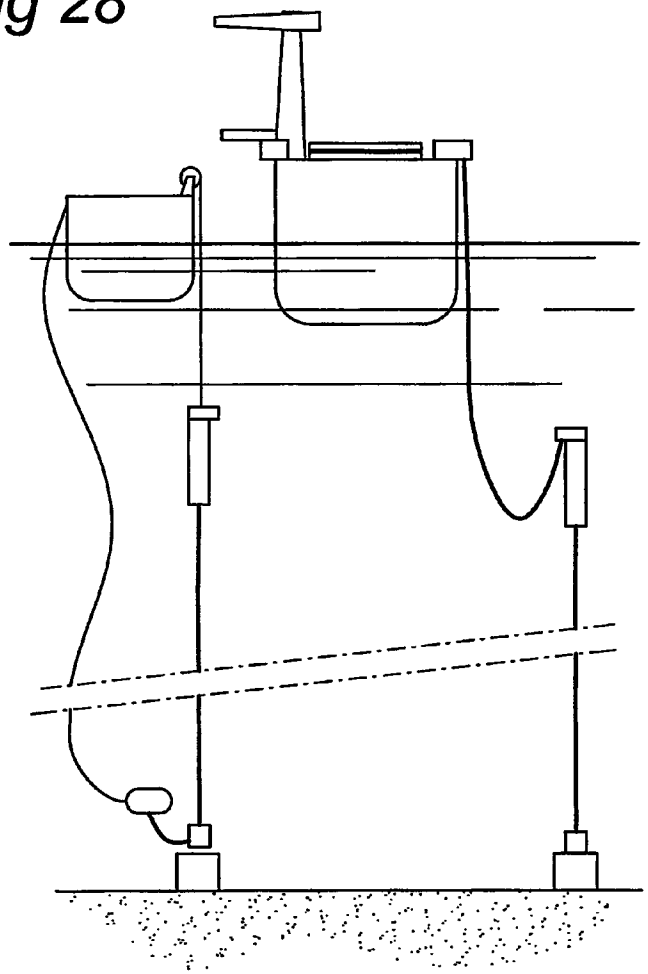
Figure 30:
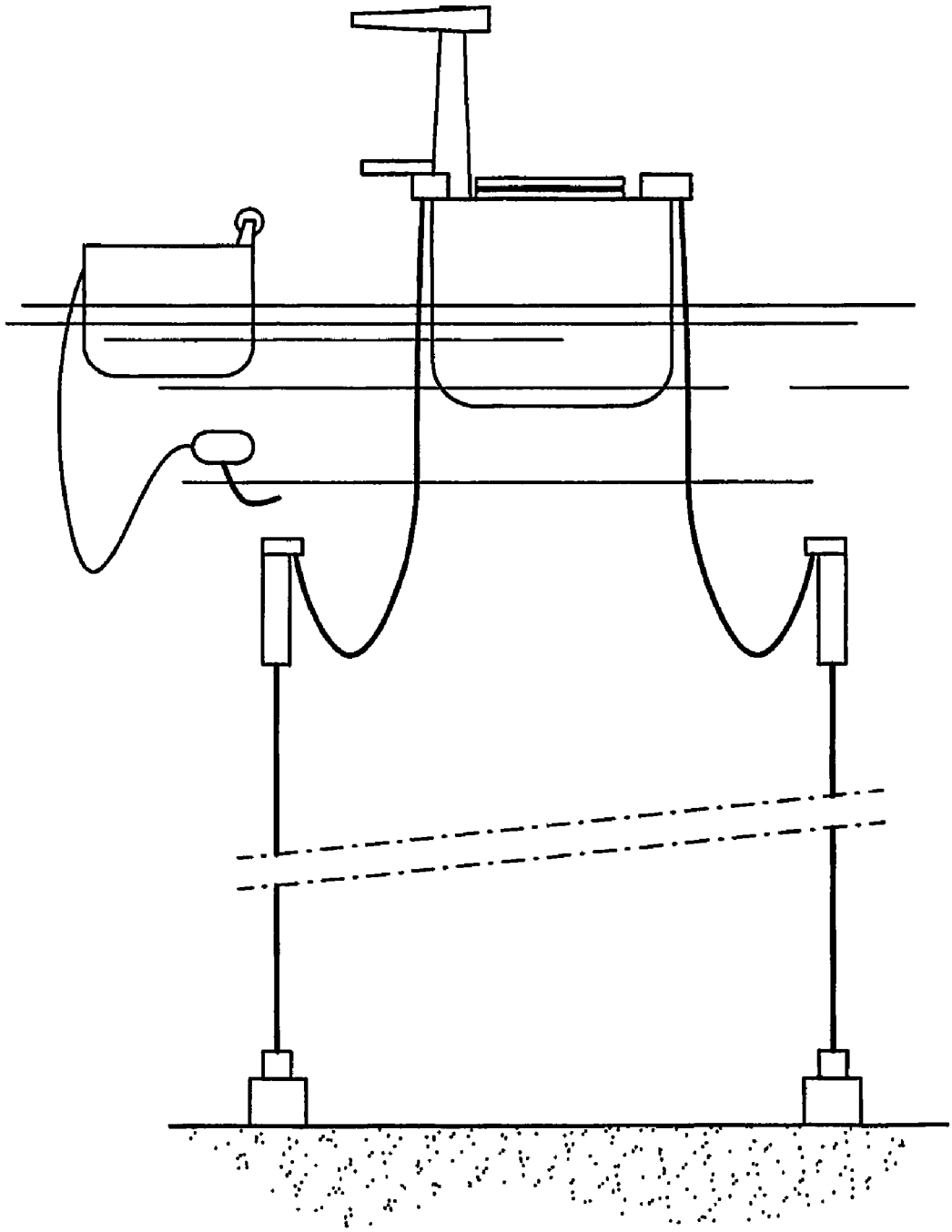

In the embodiment of FIG. 23, riser sections 83 and buoyancy member 84 are supplied from a separate supply vessel 38.

In the embodiment of FIGS. 24-30, the small working vessel 38 is employed to lower the riser 32 and buoy 11 and to operate ROV 35 for connection of the risers 32 to a wellhead and for installing flexible riser 13.

Figure 31:
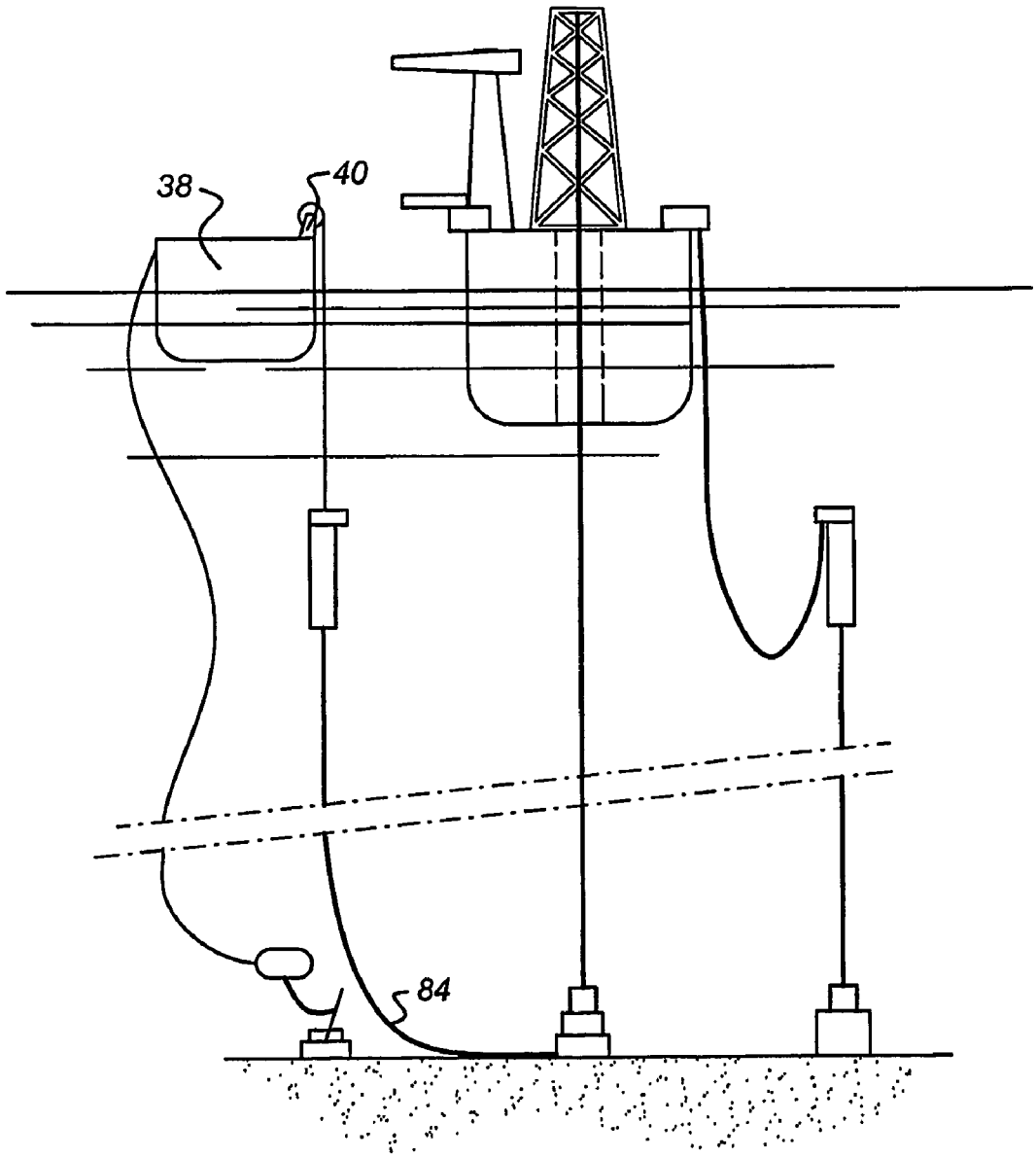
FIG. 31 shows a method of obtaining a J-configuration of the riser using a work vessel.

Finally, in the embodiment of FIG. 31 the working vessel 38 places the horizontal riser section 84 on the seabed in an upwardly extending J-configuration to obtain the riser configuration as shown at the left-hand side of FIG. 15.

The invention claimed is:

1. Vessel for exploration of hydrocarbons, comprising:

at least one riser extending from the vessel to the sea bed, a hydrocarbon processing unit on the vessel connected via a connector on the vessel to a connector at an upper end of the at least one riser and connected to a storage or transport structure for storing or transporting of the processed hydrocarbons, the vessel being anchored to the seabed, the vessel comprising a lifting means for lowering a further riser vertically towards the sea bed and for connecting a first end of the further riser with a sub sea hydrocarbon structure, a second end of the further riser having a connector attachable to a connector on the vessel for placing the further riser in fluid connection with the processing unit, the lifting means and the connectors of the at least one riser being adapted such that the at least one riser remains attached to the connector of the processing unit during the lowering and the connection of the further riser.

2. Vessel according to claim 1, the storage structure comprising a tank on the vessel.

3. Vessel according to claim 2, wherein the means for lowering comprise a crane, placed on the vessel.

4. Vessel according to claim 1, wherein, the risers extend alongside the vessel, and the lifting means comprises a crane for lowering the risers alongside the vessel.

5. Vessel according to claim 4, wherein the vessel comprises a derrick and a drill string extending from the derrick to the seabed.

6. Vessel according to claim 1, wherein the vessel further comprises a derrick and a drill string extending from the derrick to the sea bed.

7. Vessel according to claim 1, the riser comprising a lower part being made of a rigid material and being connected to a submerged buoy, an upper part of the riser being made of a flexible material and extending from the buoy to the vessel.

8. Vessel according to claim 1, the vessel comprising a shaft extending from deck level to keel level, the lifting means being located near the shaft for lowering a riser through the shaft towards the sea bed.

9. Vessel according to claim 1, the riser comprising a lower part being made of a rigid material and being connected to a submerged buoy, an upper part of the riser being made of a flexible material and extending from the buoy to the vessel.

10. Vessel according to claim 1, the vessel comprising a shaft extending from deck level to keel level, the lifting means being located near the shaft for lowering a riser through the shaft towards the seabed.

11. Vessel for exploration of hydrocarbons, comprising one or more risers extending from the vessel to the sea bed, a hydrocarbon processing unit on the vessel connected to the one or more risers and to a storage or transport structure for storing or transporting of the processed hydrocarbons, characterized in that, the vessel is anchored to the seabed, the vessel comprising a lifting means for lowering risers vertically towards the sea bed and for connecting a riser with a first end to a subsea hydrocarbon structure, which riser comprises a connector on a second end, the vessel comprising a connector for attaching to the riser connector and for placing the riser in fluid connection with the processing unit, wherein the vessel comprises a derrick and a drill string extending from the derrick, via a shaft in the vessel, to the seabed.

12. Vessel according to claim 11, the riser comprising a lower part being made of a rigid material and being connected to a submerged buoy, an upper part of the riser being made of a flexible material and extending from the buoy to the vessel.

13. Vessel according to claim 11, the vessel comprising a shaft extending from deck level to keel level, the lifting means being located near the shaft for lowering a riser through the shaft towards the seabed.

14. Method of installing a number of risers between a floating vessel and the sea bed, the vessel comprising a hydrocarbon processing unit connected to the one or more risers and a storage or transport structure for storing or transporting of the processed hydrocarbons, the vessel being anchored to the sea bed, characterized in that, the vessel comprises a lifting means for lowering risers vertically towards the sea bed and for connecting a riser with a first end to a subsea hydrocarbon structure, and a connector means on a second end of the riser and on the vessel for placing the riser in fluid connection with the processing unit, the method comprising the steps of lowering the first riser part from the lifting means, connecting an upper end of the riser to a buoyancy device, lowering the riser and buoyancy device, connecting the lower end of the first riser part to a subsea structure with a remote operated vehicle, releasing the buoyancy device from the lifting means, lowering the flexible riser part from the lifting device connecting the lower part of the flexible riser part to the buoyancy device, in fluid communication with the lower riser part, and the upper end of the flexible riser part to the processing unit.

15. Method according to claim 14, wherein prior to lowering the first riser part, a connector base is lowered to the seabed at a distance from a distribution member, a transverse pipe section is lowered to the distribution member, and is attached thereto, the vessel is moved sideways to extend the transverse pipe section over the seabed from the distribution member to the connector base, the transverse pipe section is connected to the connector base.

16. Method according to claim 14, wherein the lower end of the flexible riser part is lowered from a second vessel alongside the vessel.

17. Method according to claim 16, wherein the lower riser part is attached to the connector base and the second vessel is displaced sideways to extend the lower riser part at least partially horizontally over the seabed.

18. Method according to claim 14, wherein the lower riser part and the buoyancy device are lowered from a second vessel alongside the vessel.

19. Method according to claim 14, wherein the lower end of the flexible riser part is lowered from a second vessel alongside the vessel.

20. Method according to claim 14, wherein the lower riser part and the buoyancy device are lowered from a second vessel alongside the vessel.

* * * * *